US006626121B1

(12) United States Patent
Libæk

(10) Patent No.: US 6,626,121 B1
(45) Date of Patent: Sep. 30, 2003

(54) VESSEL OF THE OBO OR BULK CARRIER TYPE

(75) Inventor: Ole-Jacob Libæk, Oslo (NO)

(73) Assignee: Allied Applied Marine Technologies Inc., Panama (PA)

( * ) Notice: Subject to any disclaimer, the term of this patent is extended or adjusted under 35 U.S.C. 154(b) by 0 days.

(21) Appl. No.: 09/673,214

(22) PCT Filed: Aug. 16, 1999

(86) PCT No.: PCT/NO99/00125

§ 371 (c)(1),
(2), (4) Date: Dec. 8, 2000

(87) PCT Pub. No.: WO99/54195

PCT Pub. Date: Oct. 28, 1999

(30) Foreign Application Priority Data

Apr. 16, 1998 (NO) ..... 19981727
Jul. 10, 1998 (NO) ..... 19983204

(51) Int. Cl.[7] ..... B63B 25/02
(52) U.S. Cl. ..... 114/73
(58) Field of Search ..... 114/72, 73, 74 A, 114/77 R, 77 A, 201 A, 201 R, 202

(56) References Cited

U.S. PATENT DOCUMENTS 616,780 A * 12/1898 Fraser ..... 114/73
922,903 A * 5/1909 Hough ..... 114/72

(List continued on next page.)

FOREIGN PATENT DOCUMENTS

| | | | |
|---|---|---|---|
| DE | 1781166 | 10/1970 | |
| EP | 0 261 425 | 3/1988 | |
| GB | 397757 | 8/1933 | |
| GB | 962972 | 7/1964 | |
| GB | 1020724 | 2/1966 | |
| GB | 1186483 | 4/1970 | |
| GB | 1380471 | 1/1975 | |
| GB | 2143783 | 2/1985 | |
| JP | 58-116289 | * 7/1983 | ..... 114/73 |
| NO | 175424 | 10/1994 | |
| SE | 351404 | 10/1972 | |

OTHER PUBLICATIONS

MacGregor Publications Limited, "Ships and Shipping of Tomorrow", pp. 23, 26, 28 and 195–202, (1983).
Kunio Kawaski, "Elevator in Hold for Ship", Patent Abstracts of Japan of JP 52–97593, (1977).

*Primary Examiner*—S. Joseph Morano
*Assistant Examiner*—Andrew Wright
(74) *Attorney, Agent, or Firm*—Finnegan, Henderson, Farabow, Garrett & Dunner, L.L.P.

(57) ABSTRACT

A vessel of the OBO or bulk carrier type for transportation of bulk cargo, comprising transverse bulkheads (1, 2), is provided with at least one longitudinal centreline bulkhead (100) intersecting the transverse bulkheads (1, 2), the transverse bulkheads and the longitudinal centreline bulkhead (100) forming longitudinal cargo holds (11), and the cargo holds (11) are provided with hatch openings (21) which essentially cover the tank top area (41) of the respective cargo holds (11), providing a substantially "open hatch", which hatch openings (21) are provided with single piece hatch covers (31).

17 Claims, 4 Drawing Sheets

U.S. PATENT DOCUMENTS 1,391,946 A * 9/1921 Frear ..... 114/73
2,985,131 A * 5/1961 Knight, Jr. et al. ..... 114/72
2,988,036 A * 6/1961 Mooneyhan et al. ..... 114/72
3,162,169 A 12/1964 Ferris
3,279,408 A * 10/1966 Piskorz-Nalecki ..... 114/73
3,440,990 A * 4/1969 Van Riet et al. ..... 114/72
3,498,477 A * 3/1970 Sommer ..... 414/142.6
3,665,886 A * 5/1972 German ..... 114/73
3,698,347 A 10/1972 Laskey
3,766,875 A 10/1973 Baki
3,941,071 A * 3/1976 Aldecoa et al. ..... 114/73
3,957,009 A * 5/1976 Di Perna ..... 114/74 R
4,138,961 A * 2/1979 Roper ..... 114/73
4,158,416 A * 6/1979 Podesta ..... 114/72
4,308,815 A * 1/1982 Conway ..... 114/74 R
4,674,430 A * 6/1987 Murata et al. ..... 114/74 A
5,086,723 A 2/1992 Goldbach et al.
5,271,350 A * 12/1993 Newburger ..... 114/74 A
5,320,055 A 6/1994 Goldbach
5,460,208 A * 10/1995 deBarardinis ..... 141/1
5,492,075 A 2/1996 Lerstad et al.
5,503,291 A * 4/1996 Craig ..... 114/74 R
5,664,514 A * 9/1997 Laan ..... 114/74 R
5,967,072 A * 10/1999 Leary ..... 114/77 R

* cited by examiner

VESSEL OF THE OBO OR BULK CARRIER TYPE

BACKGROUND OF THE INVENTION

The present invention relates to a vessel of the OBO or bulk carrier type for transportation of bulk cargo, comprising transverse bulkheads.

An OBO vessel (ore/bulk/oil) is a vessel which can carry cargo in both liquid and dry form, and a typical use is alternation between transportation of crude oil and coal. A vessel of this type is also known as a PROBO (product/ore/bulk/oil) carrier or a combination carrier. A bulk carrier is a vessel which can carry a variety of bulk commodities mostly in dry form. OBO's and bulk carriers are single deck vessels in which the deck is important for the structural strength of the vessel. The vessel is divided into several cargo holds by transverse bulkheads with access from above provided by hatches in the deck. Each hatch opening is normally covered by a two-piece hatch cover, each of which piece is movable in the transverse direction of the vessel, and is placed on the deck between the hatch coaming and the side of the vessel when the hatch is open.

The width of the hatches, i.e. the extent of the hatches in the transverse direction of the vessel, is much smaller than the beam of the vessel, normally 50 percent of the beam of the vessel. The reason for this is two-fold: Firstly, larger hatches would not render sufficient space on deck for placing the hatch covers between the hatch coaming and the side of the vessel, and secondly, larger hatches would impair the structural strength of the vessel by rendering insufficient structural steel in the deck.

Loading of bulk cargo is normally carried out by conveyor belt/shiploaders or grabs which drop the cargo vertically into the hold. The relatively small hatch openings compared to the beam of the vessel means that the loading equipment's access to the outer parts of the hold is hindered by the deck, which forms an "overhang" above this part of the hold, normally resulting in a need for extra trimming.

Discharging of bulk cargo from a hold is normally carried out by discharging equipment temporarily located above the hatch, comprising a gantry crane with a large grab which is lowered into the bulk cargo, and which to a limited extent is moveable in the transverse direction of the hold. Again the relatively small hatch opening compared to the beam of the vessel is a limitation, as the "overhang" created by the deck hinders the grab's access to the outer parts of the hold. To get better access to the outer parts of the hold, the grab is often forced in the transverse direction of the hatch, which may cause damage to the hatch coamings. As a considerable amount of cargo is unreachable by the grab, a caterpillar is lowered into the hold to move the bulk cargo from the outer parts of the hold into the area which is accessible to the grab/discharging equipment, which is a time-consuming and costly operation.

When transporting dry cargo the hatches are closed, the hatch covers being tightened and secured to the hatch coamings.

In tanker mode, the hatch covers of the OBO vessel are in closed position, tightened and secured to the hatch coamings, both during loading, unloading and transport. The liquid cargo is loaded through the main cargo lines, via the drop lines, and discharged by the cargo pumps via the main cargo lines. The upper space of the cargo hold is filled with inert gas under pressure. Overpressure from vaporisation of the liquid cargo is controlled by a pressure vacuum valve situated in the highest point of the cargo hold. To prevent leakage through the hatch openings, leakage seals are provided between the hatch covers and the coamings.

However, the vessel is not stiff, and the load distribution, wave movements and also uneven thermal expansion due to uneven exposure to sunlight, will cause the deck and hatch coamings to bend and deflect slightly. Despite the tightening and sealing of the hatch covers, leakage therefore still occur, particularly where the two-piece hatch covers are joined above each hold. The leakage problem is thus another problem related to OBO's and bulk carriers according to prior art.

The leakage problem is also related to the material of the seals, which are normally made of a chemically resistant elastomer, such as rubber. In addition to being subjected to compression, the seals are exposed to the natural properties of the cargoes carried, such as oil or naphtha, as well as the environmental exposure from sunlight, extreme temperatures, seawater, and ice. So far an elastomer which is able to withstand all these exposures for a longer period, is unknown. A relatively frequent exchange of seals is therefore a further problem related to present OBO's and bulk carriers.

The biggest problem related to OBO's and bulk carriers, is the movement of the cargo in the hold, so-called sloshing, which may cause transverse displacement of the centre of gravity, tilting and instability of the vessel.

Tankers may have piping located in the cargo tanks. In bulk carriers, however no piping can be located in the holds, as this would prevent access for the loading and discharging equipment and complicate the cleaning of the vessel. In OBO vessels piping is therefore located on the deck where it is exposed to the environment and the cargoes carried. This exposure and sometimes extreme corrosion, caused by certain types of dry cargo mixed with seawater, and also the mechanical damages caused by various equipment used during the operation of the vessel, gives raise to the need for adequate maintenance, which again means increased operational costs for the vessel.

U.S. Pat. No. 3,698,347 discloses a vessel of the OBO type in which the holds are serviced by a pair of transversely disposed hatches and a central longitudinal girder forms a ventilating trunk extending lengthwise of the vessel and a support for the adjacent hatch coamings of the transversely disposed hatches. The hatch covers are raised and lowered by jacks and one of the pair of hatch covers of the transversely disposed hatches is movable transversely of the vessel to underneath the other of the pair of hatch covers, and both of the pairs of hatch covers are moveable "piggyback" transversely of the vessel. This OBO design thereby enables a better access to the cargo hold than the OBO discussed above. However, the problem related to the sloshing during carriage of oil or other liquid cargo is not solved. The leakage problem in tanker mode might be reduced by the central, longitudinal girder, however, as the girder will be subjected to bending and deflection, as discussed for the deck above, the leakage problem is therefore not solved.

The main object of the invention is to provide a vessel of the OBO or bulk carrier type which has a much better stability compared to known designs. There is also an object to provide a vessel of the OBO or bulk carrier type which is stronger built and therefore better suited for having hatch covers fitted on the deck, and also to carry heavier cargoes such as ore compared to known vessels. A further object is to provide a vessel of the OBO or bulk carrier type with an "open hatch" concept which is self-trimming and self-draining, and in which the access of the loading and discharging equipment is significantly improved.

A further object is to provide an OBO or bulk carrier in which the problems related to leaking hatches shall be eliminated or at least significantly reduced. It is also an object to provide an OBO or bulk carrier in which a hold can be loaded or discharged completely without significantly influencing the vessel's list. A further object is to solve the problem related to piping on deck being exposed to the environment and damages during cargo operations.

SUMMARY OF THE INVENTION

These objects are achieved by a vessel of the OBO or bulk carrier type according to the invention which comprises transverse bulkheads and at least one longitudinal centreline bulkhead intersecting the transverse bulkheads. The transverse bulkheads and the longitudinal centreline bulkhead form longitudinal cargo holds. The longitudinal form of the cargo holds and hatches facilitate unloading by the grab of a gantry crane located above the hatch, and is also advantageous with respect to strength and stiffness of the vessel.

The centreline bulkhead strengthens the deck, and enabled by this, the cargo holds are provided with large hatch openings and single piece hatch covers. The width of the hatch openings of the vessel according to the invention is essentially the same as the width or beam of the tank-tops, i.e. the bottom of the cargo holds, thus creating an "open hatch" which improves the trimming of bulk cargoes significantly. It also gives the discharging equipment, such as grabs a better access to the holds during discharging of bulk cargoes and thereby reduces the risk of stevedore damages.

This is in contrast to large OBO's and bulk carriers according to prior art which have hatch openings traverse the length of the vessel, the width of these openings being rather narrow compared to the width of the tank-tops, creating a considerable "overhang", as mentioned above.

The centreline bulkhead of the vessel according to the invention extend essentially through the length of the ship. It should, however, be understood that the centreline bulkhead may be dispensed with in areas of the vessel with no or small cargo holds, e.g. in the engine room and in the bow or stern of the vessel.

Further the OBO or bulk carrier vessel according to the invention preferably has vertical corrugations in the longitudinal centre-line bulkhead and in the transverse bulkheads of each hold. Such corrugations are known per se, however, the corrugated bulkheads of existing OBO's and bulk carriers are differently shaped, i.e. they are mostly shaped in a 90 degree pattern including the bottom plate of the corrugations (where the hopper starts) which traps the cargo inside the corrugations during discharge of bulk cargoes such as coal. By the invention the cargo will not be trapped, as all corrugations, including the bottom plate, are sloping at least about 30 degrees which will save considerable time in discharging and cleaning of the vessel. The holds in a vessel according to the invention will thus have excellent self-trimming and self-draining properties.

BRIEF DESCRIPTION OF THE DRAWINGS

The invention will now be explained by description of a preferred embodiment with reference to the accompanying drawings, in which the principles of the invention are illustrated. In the drawing.

DETAILED DESCRIPTION OF THE INVENTION

Figure 1:
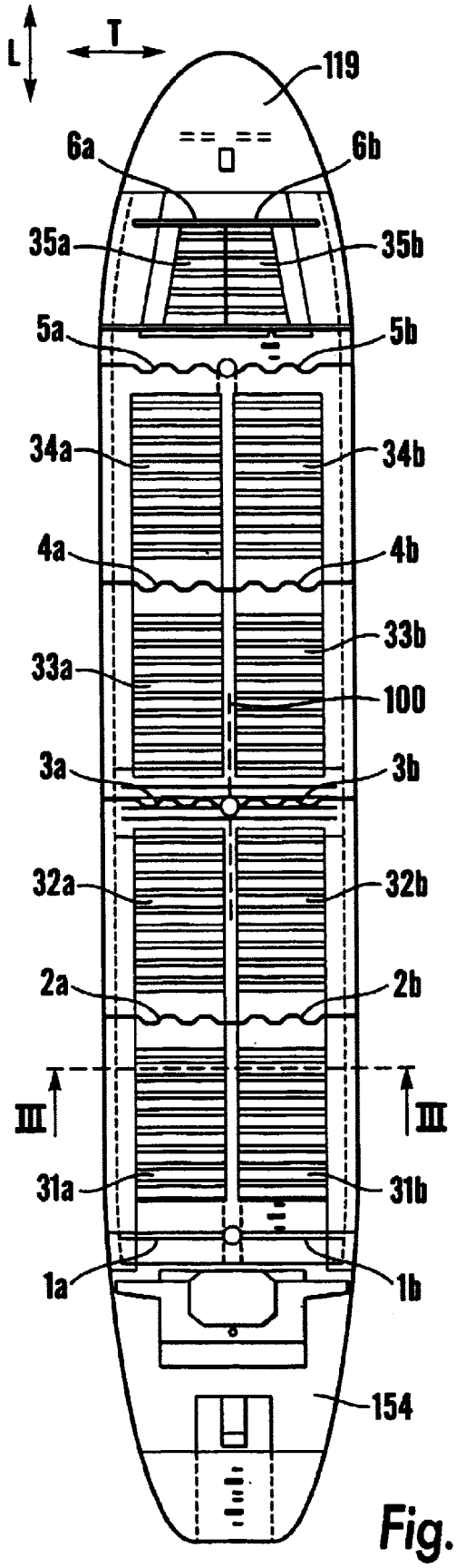
FIG. 1 is a plan view of an OBO or bulk carrier vessel according to the invention with hatch covers in closed position.

FIG. 1 is a plan view, i. e. seen from above, of an vessel of the OBO or bulk carrier type according to the invention. The vessel has a bow 119, a stern 154, transverse bulkheads 1–5 and a longitudinal centreline bulkhead 100, which intersects the transverse bulkheads. The transverse bulkheads and the centreline bulkhead forms cargo holds 11–15 for transportation of bulk cargo.

Access to the cargo holds is provided by hatches 21–25 which can be opened and closed by hatch covers 31–35.

The invention relates to cargo hold 11–14, which are covered by single piece hatch covers 31–34. Cargo hold 15 (see FIG. 2) is a smaller cargo hold located in the bow of the vessel, with no longitudinal centreline bulkhead, and which is covered by a two piece hatch cover 35*a,b* according to known design.

Figure 2:
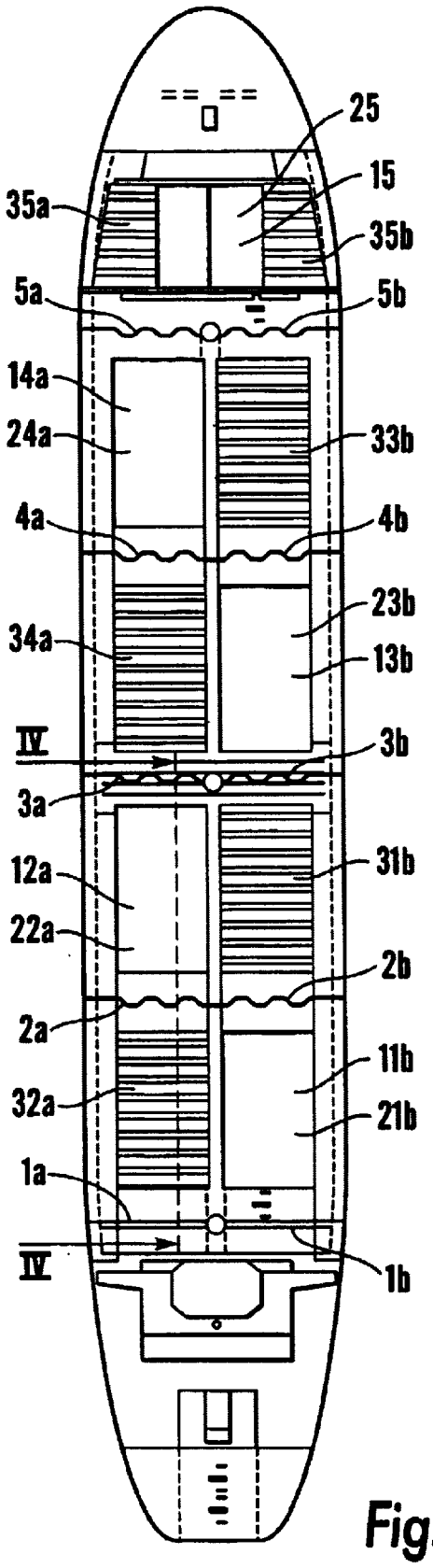
FIG. 2 is a plan view of the vessel with hatch covers in open position.

FIG. 2 illustrates the same vessel, the difference being that in FIG. 1 the hatches are closed, while in FIG. 2 half the number of hatches 31–34 are open, which is achieved by the hatch covers 31–34 being hoistable and movable into a position in which they are stacked on top of each other, "piggyback" style.

As can be seen from FIGS. 1 and 2 the embodiment illustrated has a total of 9 cargo holds. The number of holds can of course vary with the size of the vessel. Two digit reference numerals 11–99 are used for parts or portions related to the cargo holds, the first digit identify the part or portion, and the second digit indicate the cargo hold number counted from the stern of the vessel. Most of these reference numerals also have a suffix a or b, indicating port respectively starboard side of the centreline bulkhead. The suffix a or b are used correspondingly for reference numerals 1–6 for the transverse bulkheads. The total number of reference numerals would be excessive if used completely, and therefore, in order not to overload the figures, the number of reference numerals are limited to those which are regarded as necessary for the understanding of the invention.

The directions "transverse" and "longitudinal" refers to the vessel, as indicated by the arrows T and L respectively in FIG. 1.

The division of the cargo holds into port and starboard holds by the centreline bulkhead 100 strongly reduces the sloshing of the cargo, which gives the OBO or bulk carrier design according to the invention a much better stability than known designs. Additionally the centreline bulkhead increases the strength of the vessel hull, which is an added advantage when loading heavy gravity cargoes such as ore. The centreline bulkhead also provides a stiff support for the deck and the hatch coamings located along the centreline of the ship, which means that compared to OBO or bulk carrier designs according to prior art, which have only a girder or no support at all or the centreline coamings, the deflection and bending problems related to he coamings are significantly reduced. In addition the ship side will be of he double hull type, which will further increase the strength of the vessel.

The fact that the hatch covers 31–34 for the corresponding hatches 21–24 are single piece hatch covers, with no joint above the hatch which joint in previous design has been a source for leakage, is also an important feature that contributes to a substantial reduction of leakages between the hatch covers and the coamings.

Figure 3:
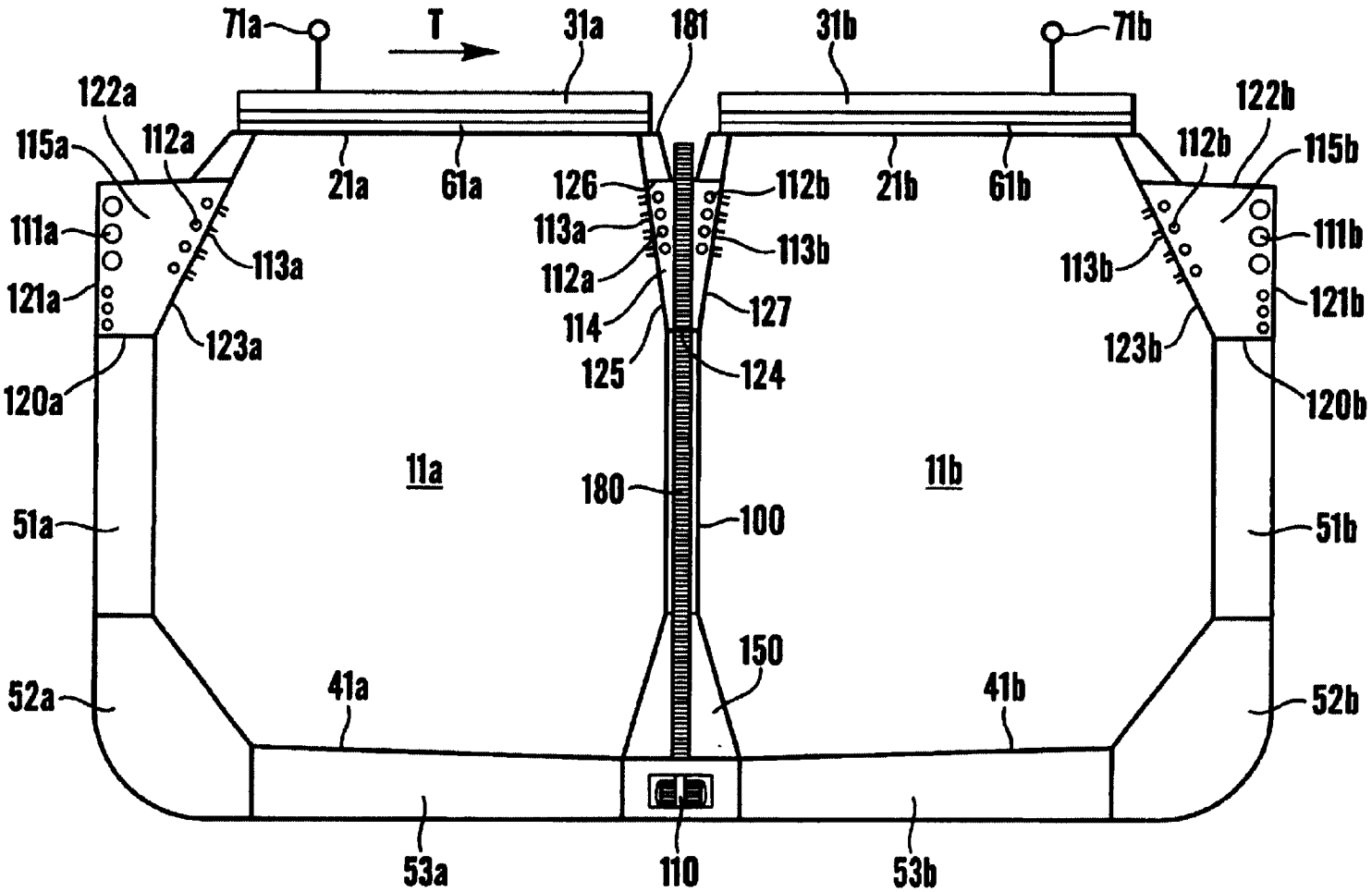
FIG. 3 shows a transverse section through the vessel.

FIG. 3 shows a transverse section through the vessel at section line III—III in FIG. 1, and illustrate the vessel hull consisting of the two cargo holds 11, ballast water tanks 51–53, upper wing holds or tanks 115, the centreline bulkhead 100 including a lower tank 150 and an upper hold or tank 114, the hatches 21 with coamings 61 and hatch covers 31. Tank-tops, i.e. the bottom of the cargo holds, are designated with 41. As for FIGS. 1 and 2 suffixes a and b designate port and starboard side of the vessel respectively.

As can be seen from FIG. 3 each of the holds 11*a*, 11*b* is covered by a hatch 21*a*, 21*b* that essentially covers the tank-top area 41*a*, 41*b* of that hold. Compared to known OBO and bulk carrier designs, in which the hatches either has been much smaller than the tank-top area, or the hatches has been divided by a girder or coaming, this is a preferred design of an <<open hatch>> concept that gives significantly improved access to the holds by the loading and discharging equipment and also improves significantly the trimming of all bulk cargoes. In addition, the vertical corrugations in the centreline and transverse bulkheads, including the bottom plate of the corrugations, are sloping at least about 30 degrees which will save considerable time in discharging and cleaning of the vessel.

The longitudinal walls 120–123 of the upper wing tanks 115 are preferably continuous in the longitudinal direction L of the vessel. These walls thereby forms longitudinal girders which contribute to the structural integrity of the vessel. Similarly the longitudinal walls 124–127 of the upper tanks 114 of the centreline bulkhead 100 also preferably should be continuos, also forming a longitudinal girder which serves the same purpose as the girders formed by the longitudinal walls of the upper wing tanks. The girders formed by the continuity of the longitudinal tank walls should preferably at least extend through the central portion of the vessel, as this is the portion of the vessel which is most subjected to bending. Together with the longitudinal walls of the ballast tanks these girders provide torsional and bending stiffness and strength to the vessel, which from a constructional point of view is very important. The continuity of the longitudinal walls of the upper wing tanks and the upper tanks of the centreline bulkhead compensates for lack of continuity in the vessel deck due to the width of the hatches being almost identical to the width of the deck, and the continuity of the longitudinal walls of these tanks is therefore an important feature of the new OBO or bulk carrier design.

FIG. 3 also shows a pump 110 located below the centreline bulkhead, between the ballast water tanks 53*a* and *b*. This pump is used for pumping ballast water transversely between the ballast water tanks 51*a*, 52*a* and 53*a* on port side of the vessel and corresponding ballast water tanks 51*b*, 52*b* and 53*b* on starboard side of the vessel for compensation of uneven cargo distribution between the holds. If required ballast water may also be pumped between ballast water tanks located on the same side of the vessel. Provided correct sizing of the pump 110 and the ballast water tanks, a hold can thereby be loaded or unloaded completely without significantly influencing the vessel's list, the pump being controlled by an automatic anti-heeling system.

In FIG. 3 is also illustrated a ladder 180 for access to the cargo holds 11 from the deck 181. The ladder 180 is located inside the centreline bulkhead 100, which is a double-walled bulkhead, and extends through the upper centreline bulkhead tank 114 and the lower centreline bulkhead tank 150. Access to the cargo holds 11 from the ladder is provided through not shown hatches in the centreline bulkhead. Also located in the upper centreline bulkhead tank 114 are equipment and auxiliary service pipes, namely wash water pipes 112, and wash water inlets 113, opening into the holds 11. In the upper wing tanks 115*a,b*, which may be used as ballast water tanks, are located wash water pipes 112 and wash water inlets 113, and also cargo pipes 111*a,b*. The location of the pipes in the upper centreline bulkhead tank and the upper wing tanks ensures that the pipes with corresponding valves and couplings are sheltered from exposure to the environmental surroundings, like corrosive seawater, and also ensures a location in which risk for damage due to accidental impacts from loading and unloading equipment is eliminated.

Figure 4:
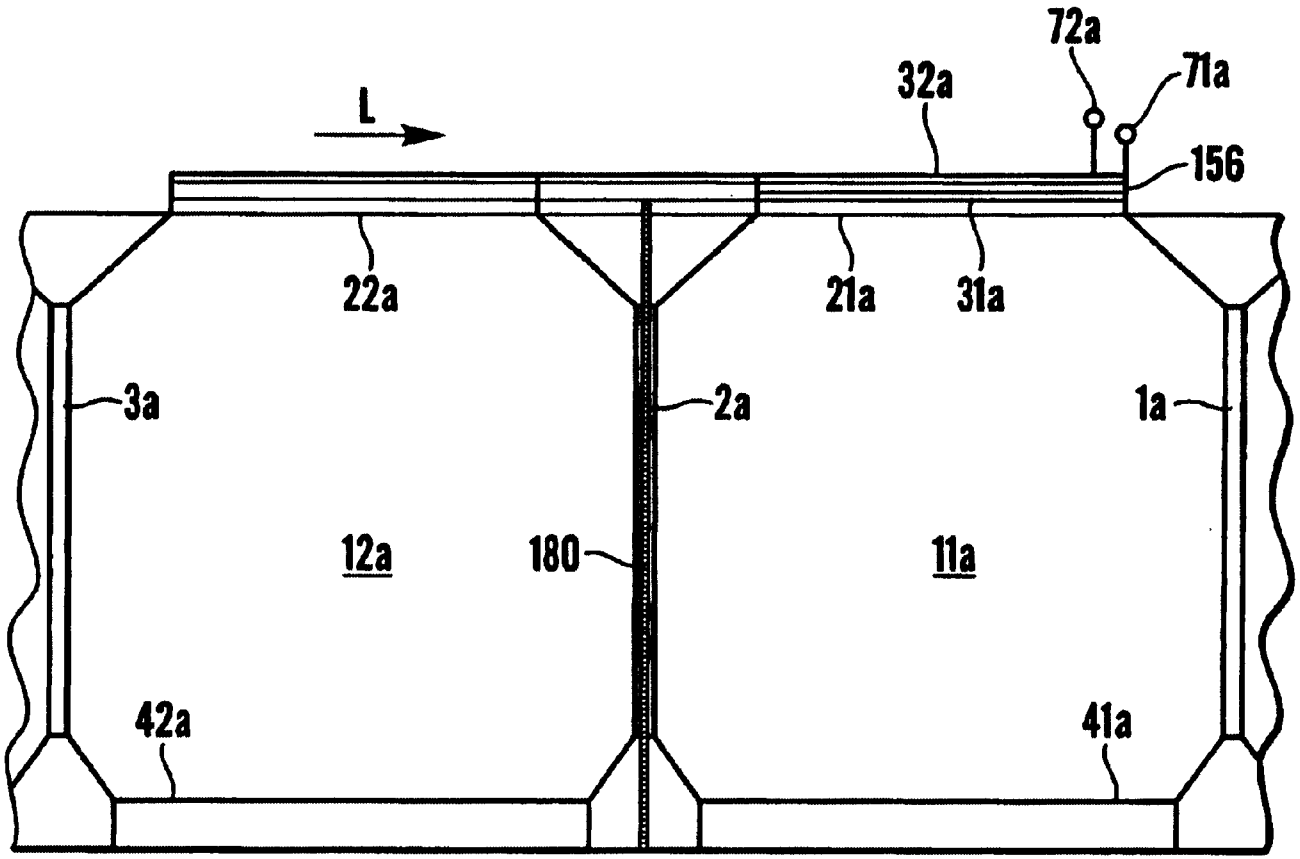
FIG. 4 shows a longitudinal section through the vessel.

FIG. 4. shows a longitudinal section through a portion of the vessel at section line IV—IV in FIG. 2, and illustrates holds 12*a* and 11*a* with hatches 21*a*, 22*a* and tank tops 41*a*, 42*a*, confined by transverse bulkheads 1*a*, 2*a* and 3*a*. FIG. 4 further illustrates the hatch covers in a position in which they are stacked on top of each other, in the so-called <<piggyback>> style. Hatch cover 32*a*, which in the closed position is located on top of hatch 22*a*, is during opening of the hatch lifted by not shown hydraulic cylinders and moved longitudinally by a not shown roller-arrangement, into the position on top of hatch cover 31*a*. The hatch covers in the illustrated embodiment are movable in the longitudinal direction t of the vessel, which in contradiction to a design in which the hatch covers are movable in the transverse direction, means that both hatch covers for a pair of transversely adjacent holds simultaneously can be stacked onto the neighbouring pair of hatch covers, meaning that the two transversely adjacent holds can be accessed simultaneously. This is in contradiction to FIG. 2, which shows a zigzag stacking of the hatch covers.

FIG. 4 also shows pressure vacuum valves 71*a* and 72*a* for the cargo holds 11*a* and 12*a* respectively, mounted in hatch covers 31*a* and 32*a*. It is further illustrated how pressure vacuum valve 71*a* in hatch cover 31*a*, hatch cover 31*a* being the lower hatch cover in the stacked position, is located on that edge 156 of hatch cover 31*a* that faces away from the upper hatch cover 32*a*. This enables the hatch covers to be stacked on top of each other without collision between the upper hatch cover and the pressure vacuum valve in the lower hatch cover.

Figure 5:
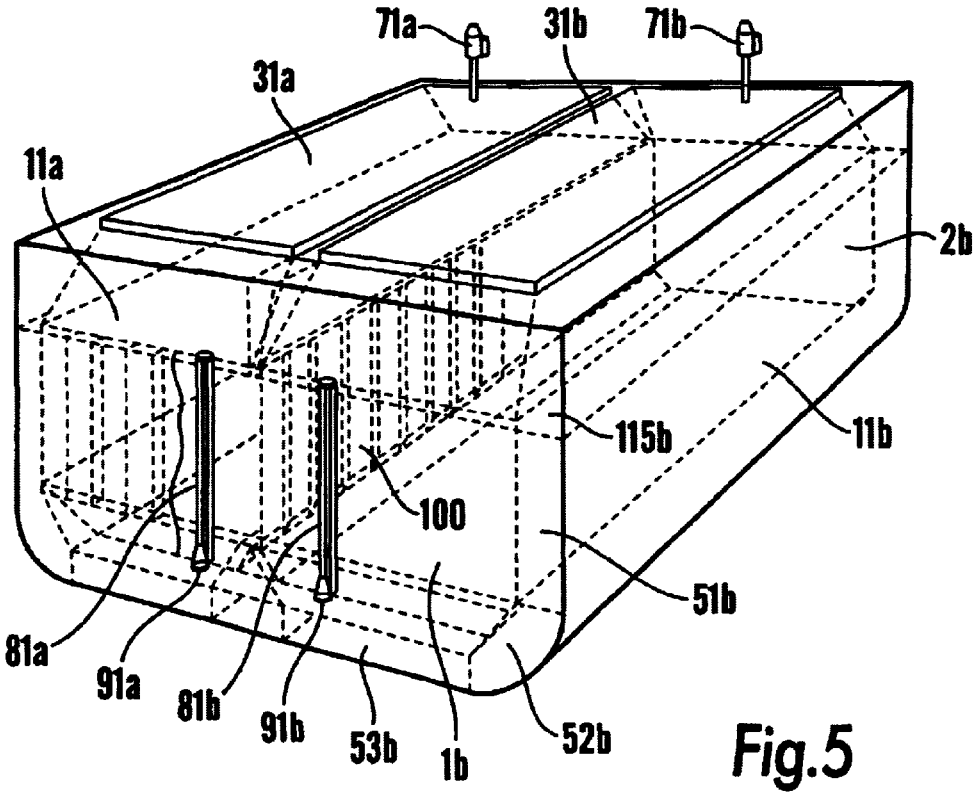
FIG. 5 is a perspective view of a portion of the vessel comprising two cargo holds.

FIG. 5 is a perspective view of a portion of a OBO vessel comprising two cargo holds 11*a* and 11*b*, and illustrates the 3-dimensional extent of the various items and portions previously discussed. FIG. 5 also illustrates cargo pumps 81*a* and *b* for liquid cargo located in the transverse bulkheads 1*a* and *b* respectively, with inlets 91*a* and *b* opening into the cargo holds. This design, in which the cargo pumps are located outside the holds, enables discharging and cleaning of the holds without any interference with the pumps, piping or other items related to the pumps.

Figure 6:
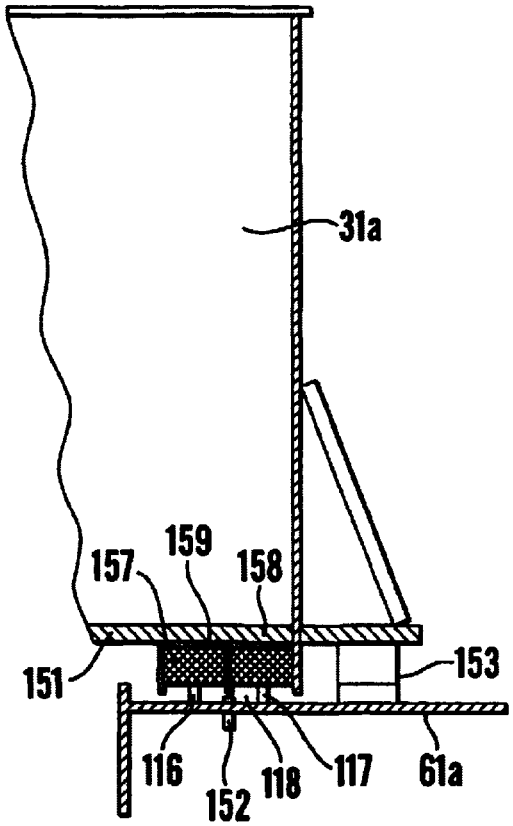
FIG. 6 illustrates a double hatch seal according to the invention.

FIG. 6 illustrates an edge of hatch cover 31*a* and its corresponding coaming 61*a* with a double hatch seal according to the invention. The lower portion 151 of the hatch cover 31*a* is provided with a seal bracket 159, which in turn is provided with an inner seal 157 and an outer seal 158, made from an elastomer. An inner seal counterpart 116 and an outer seal counterpart 117 are correspondingly attached to the coaming 61*a* for sealing purposes. An abutment portion 153 of the hatch cover abuts against the coaming and transfer the major part of the load between the hatch cover and the coaming. The inner seals 157 are resistant towards the natural properties of the cargoes carried whereas outer seals 158 are resistant towards ambient surroundings such as sunlight, extreme temperatures and seawater. It is thereby obtained a durable seal with a longer life-time.

A space 118 between the seals is via a connection 152 connected to a leakage detector/alarm system, not shown. This system may be based on generating an overpressure or underpressure in the space and measuring pressure loss or increase, or based on a gas or moisture detection by a detector. It should be understood that the details of the seal design with the space 118 may vary according to the seal manufacturer.

The invention has above been explained with reference to a specific embodiment. Variations are however possible within the frame of the invention, and a particular example of such variations is various designs of the centreline bulkhead. The centreline bulkhead may be a cofferdam bulkhead or a single-walled bulkhead, and it may be strengthened by internal or external stiffeners or corrugations. A design with more than one centreline bulkhead, e.g. two longitudinal bulkheads located in the central area of the vessel, is also conceivable. Finally the possibility of placing the centreline bulkhead slightly offset from the geometrical centreline should be mentioned. All such variations of the centreline bulkhead design would be obvious to a man skilled in the art, and consequently be within the frame of the invention.

In order not to overload the claims with reference numerals, only those reference numerals which are regarded necessary for the understanding of the invention are included.

What is claimed is:

1. A vessel of the ore/bulk/oil or bulk carrier type for transportation of bulk cargo, comprising a hull defining a cargo area under a single deck, the cargo area having a plurality of transverse bulkheads, including a forward end transverse bulkhead, an aft end transverse bulkhead, and intermediate transverse bulkheads between the forward end transverse bulkhead and the aft end transverse bulkhead, a longitudinal centreline bulkhead extending continuously between the aft end transverse bulkhead and the forward end transverse bulkhead and intersecting the intermediate transverse bulkheads, the transverse bulkheads and the longitudinal centreline bulkhead forming longitudinal cargo holds, each cargo hold having a longitudinal length greater than a transverse breadth thereof and having a hatch opening in the single deck and essentially covering a bottom area thereof, thereby to provide a substantially open hatch for access to each cargo hold, and single piece hatch covers for covering the respective hatch openings.

2. The vessel of claim 1, wherein the hatch covers for two adjacently located hatch openings are movable into a position to be stacked on top of each other.

3. The vessel of claim 2, wherein pressure vacuum valves for the cargo holds are mounted in the hatch covers, the pressure vacuum valve in a lower of stacked hatch covers being located on an edge of the lower hatch cover facing away from an upper stacked hatch cover.

4. The vessel of claim 1, wherein both the centreline bulkhead and the transverse bulkheads of each hold are provided with vertical corrugations and wherein the corrugations, including a bottom plate, are sloped at least about 30 degrees.

5. The vessel of claim 1, wherein sides of the vessel are of double hull construction.

6. The vessel of claim 1, including upper wing tanks outboard of the longitudinal holds and having continuous longitudinal walls, thereby forming longitudinal girders of the vessel.

7. The vessel of claim 6, wherein cargo pipes are located in the upper wing tanks.

8. The vessel of claim 1, including upper tanks in the centreline bulkhead and having continuous longitudinal walls, thereby forming a longitudinal girder of the vessel.

9. The vessel of claim 8, wherein equipment and auxiliary service pipes are located in the upper tanks of the centreline bulkhead.

10. The vessel of claim 1, including pumps for pumping ballast water between ballast water banks on each side of the vessel for compensation of uneven cargo distribution.

11. The vessel of claim 1, wherein the hatch openings are provided with inner seals that are resistant towards the natural properties of the cargoes, and outer seals that are resistant towards ambient surroundings, and a leakage detector/alarm system is provided in a space between the seals.

12. The vessel of claim 1, wherein ladders for access to the cargo holds from a deck of the vessel are located in the centerline bulkhead.

13. The vessel of claim 1 comprising a pair of longitudinal centerline bulkheads.

14. The vessel of claim 1, wherein the longitudinal centerline bulkhead ends at the forward end transverse bulkhead and at the aft end transverse bulkhead.

15. A vessel of the ore/bulk/oil or bulk carrier type for transportation of bulk cargo, comprising a hull defining a cargo area under a single deck, the cargo area having a plurality of transverse bulkheads including a forward end transverse bulkhead and an aft end transverse bulkhead, and intermediate transverse bulkheads between the forward end transverse bulkhead and the aft end transverse bulkhead, a longitudinal centreline bulkhead extending continuously between the aft end transverse bulkhead and the forward end transverse bulkhead and intersecting the intermediate transverse bulkheads, the transverse bulkheads and the longitudinal centreline bulkhead forming longitudinal cargo holds, each cargo hold having a longitudinal length greater than a transverse breadth thereof and a hatch opening in the single deck and essentially covering a bottom area thereof, thereby to provide a substantially open hatch for access to each cargo hold, and single piece hatch covers for covering the respective hatch openings, the hatch covers for two adjacently located hatch openings being movable in a longitudinal direction of the vessel into a position so that both hatch covers for a pair of transversely adjacent holds can be stacked onto a longitudinally adjacent pair of hatch covers to facilitate simultaneous access to the transversely adjacent holds.

16. The vessel of claim 15 comprising a pair of longitudinal centerline bulkheads.

17. The vessel of claim 15, wherein the longitudinal centerline bulkhead ends at the forward end transverse bulkhead and at the aft end transverse bulkhead.

* * * * *